US007513369B1

(12) United States Patent
Lee

(10) Patent No.: US 7,513,369 B1
(45) Date of Patent: Apr. 7, 2009

(54) PACKAGE HAVING A ROTATABLE DISPLAY ELEMENT

(75) Inventor: Choongseo Lee, Attleboro, MA (US)

(73) Assignee: Hasbro, Inc., Pawtucket, RI (US)

( * ) Notice: Subject to any disclaimer, the term of this patent is extended or adjusted under 35 U.S.C. 154(b) by 290 days.

(21) Appl. No.: 11/075,191

(22) Filed: Mar. 8, 2005

(51) Int. Cl.
*B65D 85/00* (2006.01)

(52) U.S. Cl. ..... 206/779; 206/462; 206/485; 206/583; 206/806

(58) Field of Classification Search ..... 206/315.1, 206/461–471, 775–782, 806, 485, 583
See application file for complete search history.

(56) References Cited

U.S. PATENT DOCUMENTS

| | | | | |
|---|---|---|---|---|
| 3,995,767 | A * | 12/1976 | Brindley et al. | 206/704 |
| 4,119,203 | A | 10/1978 | Kuchenbecker | 206/461 |
| 4,210,246 | A | 7/1980 | Kuchenbecker | 206/461 |
| 4,266,666 | A | 5/1981 | Kuchenbecker | 206/461 |
| 4,415,084 | A | 11/1983 | Hauser et al. | 206/461 |
| 4,569,442 | A | 2/1986 | Bushey | 206/469 |
| 4,574,951 | A | 3/1986 | Weaver | 206/461 |
| 4,632,245 | A | 12/1986 | Lerner | 206/315.1 |
| 4,724,964 | A | 2/1988 | Hernandez | 206/461 |
| 4,771,888 | A | 9/1988 | Lundeen | 206/387 |
| 5,232,095 | A | 8/1993 | Childers et al. | 206/583 |
| 5,348,145 | A | 9/1994 | Steinfels, III | 206/45.19 |
| 5,868,249 | A | 2/1999 | Ehnert | 206/315.9 |
| 5,881,885 | A * | 3/1999 | Grimm | 206/779 |
| 5,888,565 | A * | 3/1999 | Gics | 206/769 |
| 5,896,996 | A * | 4/1999 | Chuang | 206/769 |
| 6,126,008 | A | 10/2000 | Cox | 206/471 |
| 6,189,690 | B1 * | 2/2001 | Izen et al. | 206/485 |
| 6,199,804 | B1 | 3/2001 | Donofrio, Jr. | 248/121 |
| 6,276,529 | B1 | 8/2001 | Feehan, Jr. | 206/469 |
| 6,708,820 | B2 | 3/2004 | Hansen et al. | 206/308.1 |
| 2002/0139699 | A1 | 10/2002 | Hansen et al. | 206/308.1 |
| 2003/0111384 | A1 * | 6/2003 | Schein et al. | 206/703 |

* cited by examiner

*Primary Examiner*—Luan K Bui
(74) *Attorney, Agent, or Firm*—Marshall, Gerstein & Borun LLP

(57) ABSTRACT

The invention is directed to a package and a method for displaying a product. The package may include a center element defining a hollow compartment enclosing a product disposed therein. The center element may include a pair of shafts extending outwardly from opposite sides of the center element, and multiple sides of the product may be visible from the exterior of the center element. The package may also include a support element including a pair of notches defined therein each corresponding to one of the shafts of the center element. The notches may receive the corresponding shafts of the center element to demountably engage the center element such that the center element is manually rotatable so that multiple sides of the product disposed within the center element may be viewable by the individual. The package may further include a package structure receiving the center element and support element therein, and including an opening for viewing the product and manually rotating the center element.

33 Claims, 7 Drawing Sheets

PACKAGE HAVING A ROTATABLE DISPLAY ELEMENT

BACKGROUND OF THE INVENTION

The patent is directed to packages for displaying products, and more particularly to a package having a rotatable display element containing the displayed product and being rotatable to display multiple sides of the displayed product.

Various packages for displaying products have been previously described. For example, U.S. Pat. No. 5,868,249 to Ehnert discloses an enclosed transparent display case for sports balls comprising a base section removably attached to a rounded top section that incorporates rotatably affixed handle calipers to secure and suspend the sports ball within the display case. The display case provides the ability to suspend the ball within the interior of the display case, and to allow the ball to be rotatably controlled by a viewer and observe the ball with a clear view and a normal viewing angle without picking up the display or removing the ball.

U.S. Pat. No. 5,881,885 to Grimm discloses a capture/display packaging structure for a ball-like, or other hand-manipulable, article including an enclosure having spaced, opposite sides and an open exposure window intermediate the sides exposing a capture/display area for the article. The packaging structure also includes a pinioning structure including at least one portion extending adjacent one of the sides into the capture/display area adapted to pinion an article on display in the capture/display area.

U.S. Pat. No. 6,199,804 to Donofrio, Jr. discloses a display device including a base, first and second arms extending from the base, and first and second retainers attached respectively to the first and second arms. Either the arms or the retainers are flexible such that the retainers can be spread apart to receive a ball and then released to hold the ball therebetween. The display device also includes sports memorabilia held between the first and the second retainers.

Other types of packages for supporting products during shipping have been previously described. For example, U.S. Pat. No. 5,232,095 to Childers et al. discloses an apparatus for shipping goods which must be maintained in a predetermined orientation. A closable outer container has a shaft passing through it along an axis. A weighted closable inner container is rotatably mounted about this axis so that it may freely rotate within the outer container while always assuming a predetermined orientation.

SUMMARY OF THE INVENTION

In one aspect the invention is directed to a package for displaying a product. The package may include a center element defining a hollow compartment enclosing a product disposed therein, wherein multiple sides of the product are visible from the exterior of the center element. The package may further include a support element receiving the center element such that the center element is manually rotatable so that multiple sides of the product disposed within the center element are viewable by an individual.

In another aspect, the invention is directed to a package for displaying a product. The package may include a center element defining a hollow compartment enclosing a product disposed therein. The center element may include a pair of shafts extending outwardly from opposite sides of the center element, and multiple sides of the product may be visible from the exterior of the center element. The package may also include a support element including a pair of notches defined therein each corresponding to one of the shafts of the center element. The notches may receive the corresponding shafts of the center element such that the center element is manually rotatable so that multiple sides of the product disposed within the center element may be viewable by an individual. The package may further include a package structure receiving the center element and support element therein and including an opening for viewing the product and manually rotating the center element.

In a further aspect, the invention is directed to a method for displaying multiple sides of a product disposed within a package. The method may include enclosing a product within a hollow compartment of a center element, wherein multiple sides of the product are visible from the exterior of the center element. The method may further include receiving the center element at a support element such that the center element is manually rotatable so that multiple sides of the product disposed within the center element are viewable by the individual.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
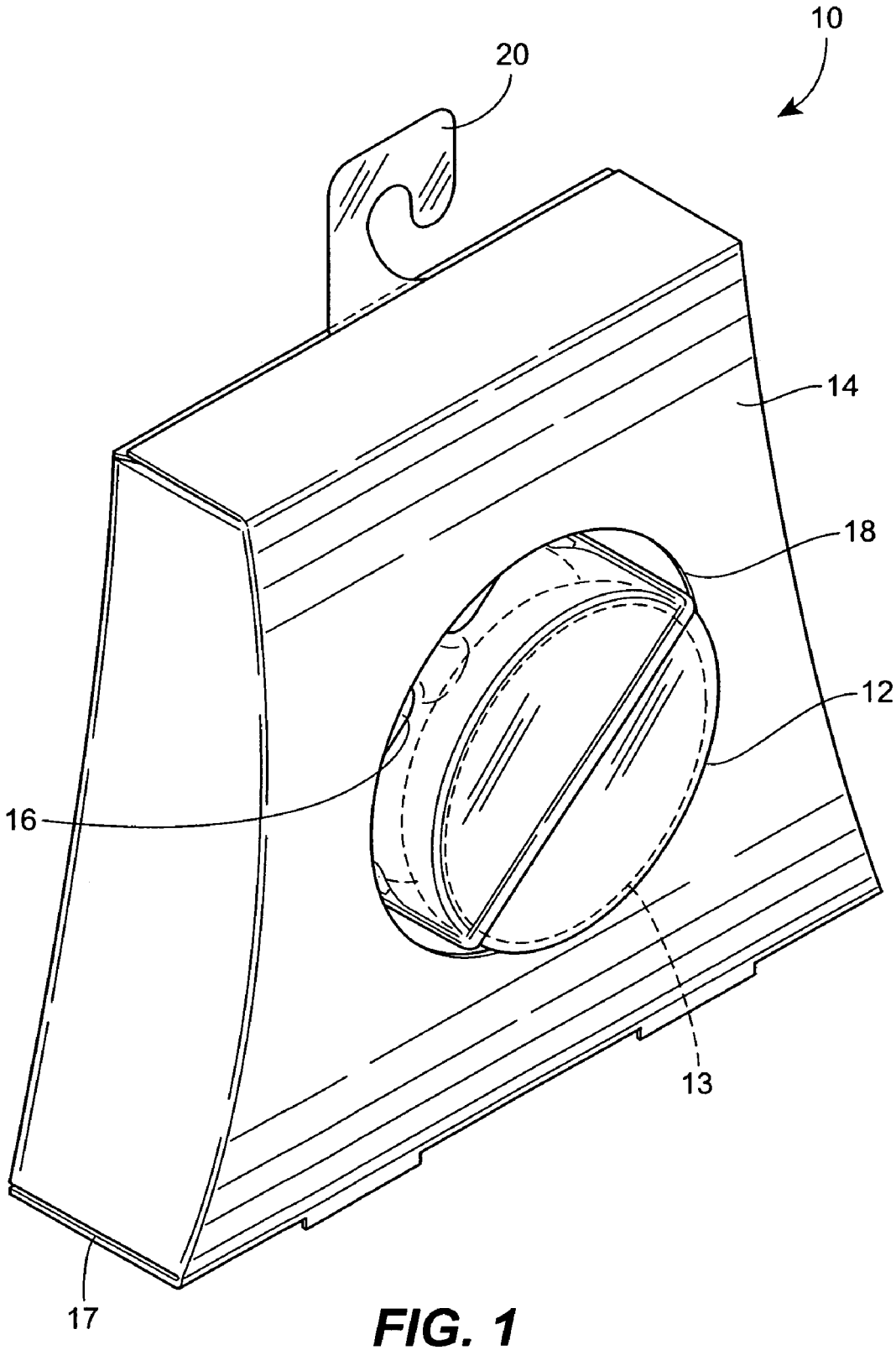
FIG. 1 is a perspective view of an embodiment of a package having a rotatable display element.

FIGS. 1-7 illustrate one possible embodiment of a product display package 10 having a rotatable center element 12 in accordance with the invention that may be used to display a product 13 for sale, such as a yo-yo or other toy, or any other product that may be displayed in the package, in such a manner that a potential purchaser may be able to see multiple sides of the product 13. Referring to FIG. 1, the package 10 may include an outer package structure 14 enclosing the center element 12 and a support element 16. The outer package structure 14 may be fabricated from a piece of cardboard, or may be fabricated from any other appropriate material in which the center element 12 and support element 16 may be disposed. For example, the outer package structure 14 may be fabricated from polyvinyl chloride (PVC) or any other polymer or other material that may be fully or partially transparent or translucent such that the center element 12 and enclosed product 13 may be fully or partially visible therethrough. The package structure 14 may include a flap 17 along a side that may be opened for insertion and removal of the center element 12 and support element 16. The outer package structure 14 may further include an opening 18 through a surface of the outer package structure 14 and positioned such that the center element 12 may be visible and accessible through the opening 18. Depending on the manner in which the package 10 may be displayed, the package 10 may include an upwardly extending hanger 20 attached to or integrally formed with the outer package structure 14, and through which a peg on a display wall may be inserted if the package 10 is intended to be hung.

Figure 2:
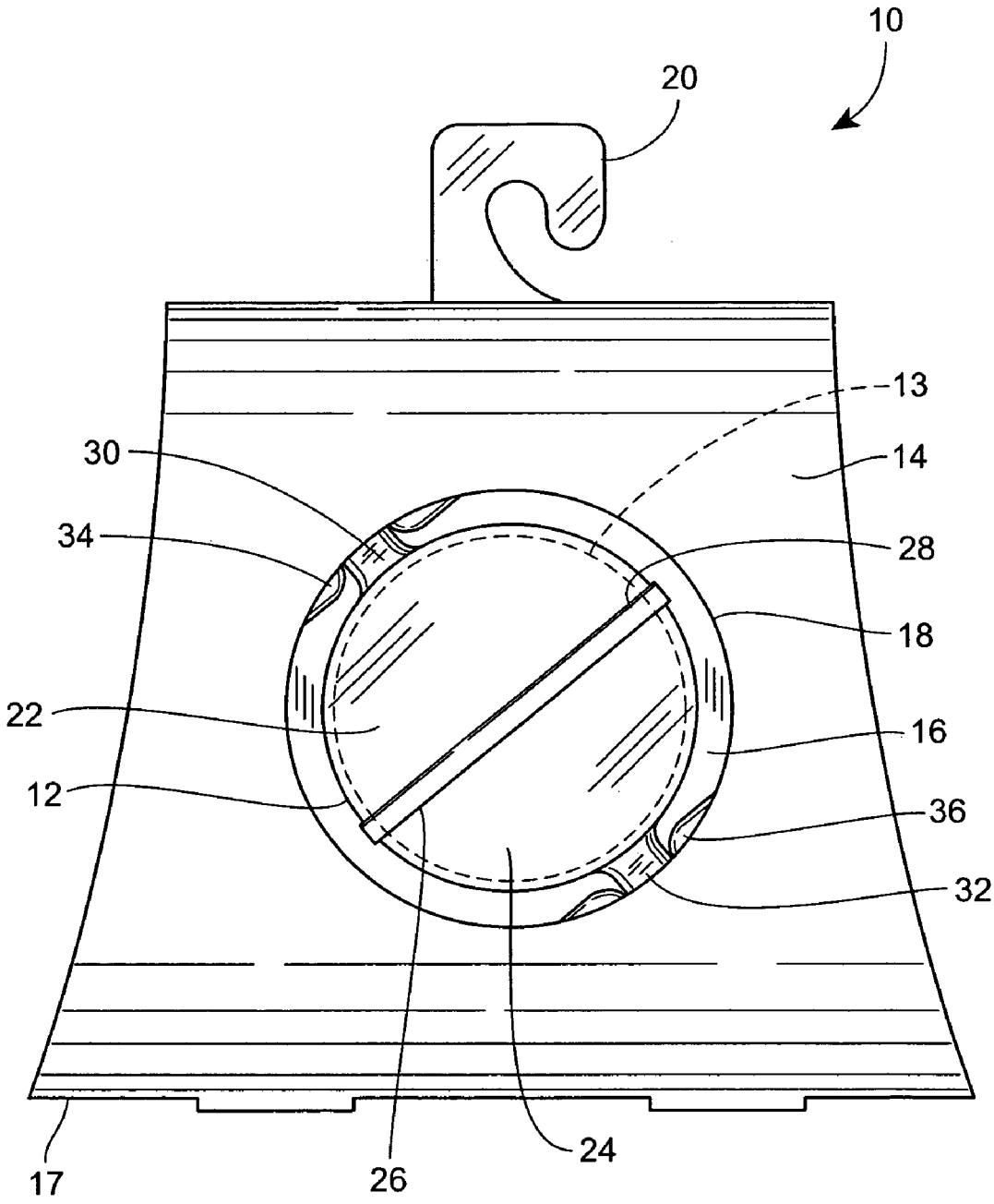
FIG. 2 is a front view of the package of FIG. 1 with the rotatable display element in a first orientation.
Figure 3:
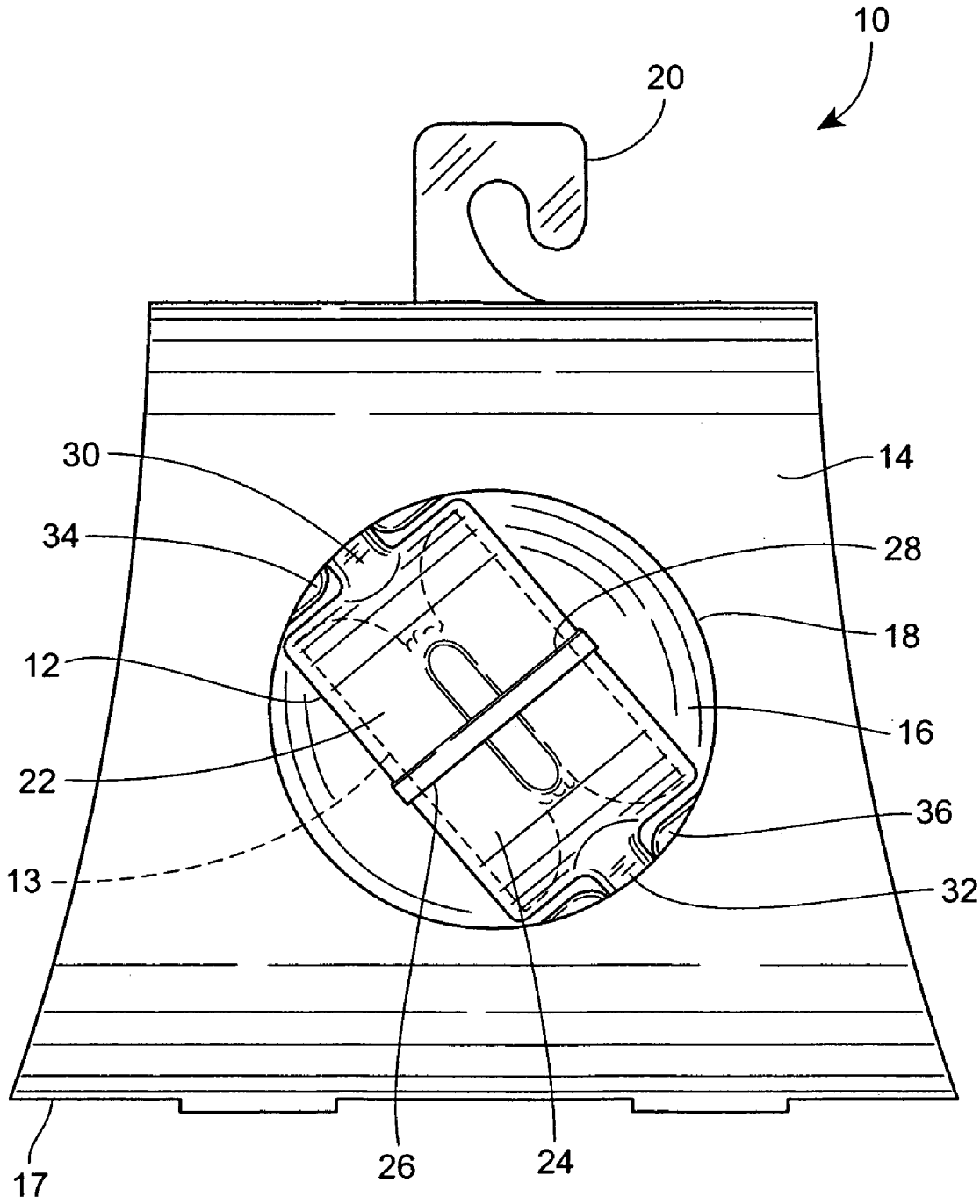
FIG. 3 is a front view of the package of FIG. 1 with the rotatable display element in a second orientation.

Referring to FIG. 2, the package 10 is illustrated with the center element 12 and support element 16 disposed within the outer package structure 14, with the center element 12 oriented such that a first side of the displayed product 13, in this example a yo-yo, may be visible and accessible through the opening 18 of the outer package structure 14. In order to facilitate enclosing the displayed product within the center element 12, the center element 12 may include first and second portions 22, 24, respectively, combining to define a hollow compartment within the center element 12 in which the displayed-product may be disposed. The first and second portions 22, 24 of the center element 12 may be fabricated from PVC or any other polymer or other material that may be fully or partially transparent or translucent such that the product 13 may be fully or partially visible therethrough. In the illustrated embodiment, the first and second portions 22, 24 may be configured such that the edge 26 of the first portion 22 may receive the edge 28 of the second portion 24 to close the center element 12. Alternatively, the center element 12 may be fabricated in any other manner or from any other material that may allow for the display of multiple sides of the product 13. For example, the center element 12 may be fabricated from a non-translucent material and include openings therethrough for viewing multiple sides of the product 13. Still further, the center element 12 may be fabricated from a plastic or wire mesh allowing multiple sides of the product 13 to be viewed while functioning to rotatably support the product 13.

The center element 12 may further include a pair of outwardly extending shafts 30, 32 that may be received in corresponding notches 34, 36, respectively, defined in the surface of the support element 16. The shafts 30, 32 and notches 34, 36 may be configured such that notches 34, 36 retentively engage the shafts 30, 32 when the center element 12 and support element 16 are disposed within the outer package structure 14, with the shafts 30, 32 being rotatable within the notches 34, 36 to rotate the center element 12 to other orientations, such as that shown in FIG. 3, to display multiple sides of the product 13 enclosed within the center element 12. In order to retain the center element 12 within the support element 16 and package structure 14, the package structure 14 may engage the center element 12 and/or the support element 16 to prevent the shafts 30, 32 from being detached from the notches 34, 36 when the center element 12 and support element 16 are disposed within the package structure 14. Further, the opening 18 may be dimensioned such that the center element 12 may be engageable by a potential purchaser and be free to rotate through the desired range of motion without engaging the outer wall of the package structure 14 to allow the potential purchaser to view multiple sides of the product 13. Moreover, the center element 12, package structure 14, and support element 16 may be configured such that the center element 12 at least partially extends outwardly through the opening 18 and is at least partially disposed external to the surface of the package structure 14.

Figure 4:
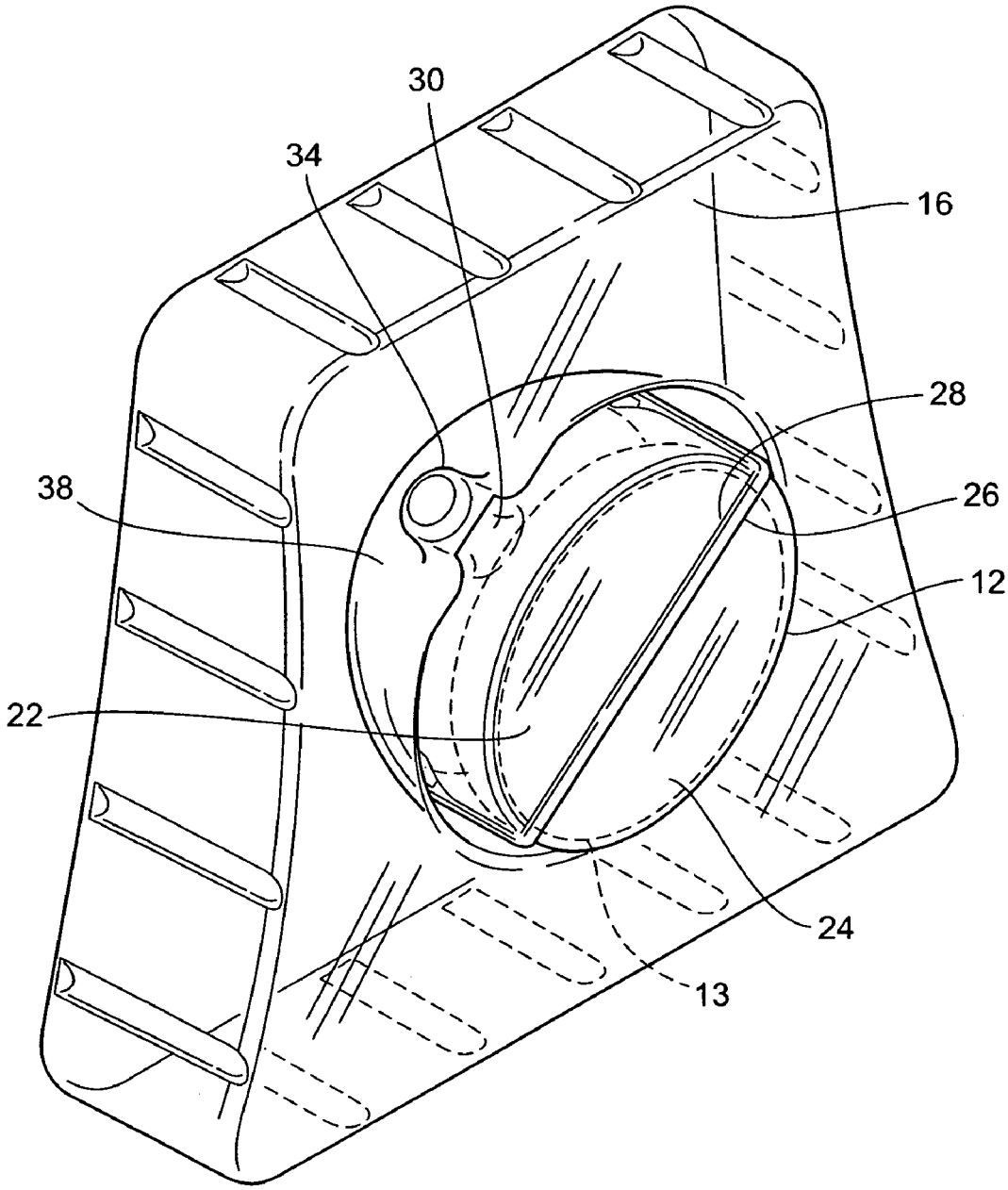
FIG. 4 is a perspective view of the support element and display element of the package of FIG. 1.
Figure 5:
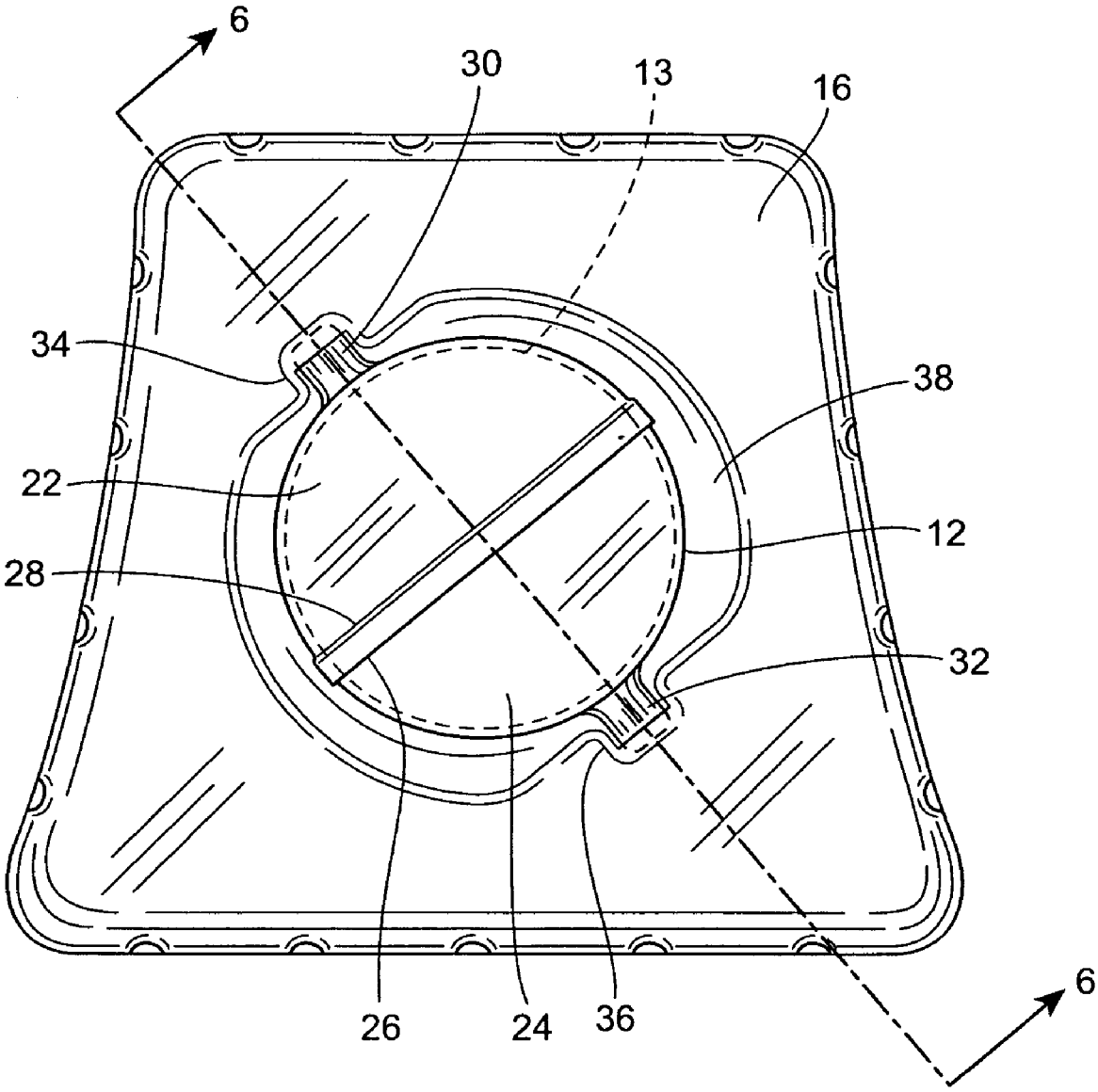
FIG. 5 is a front view of the support element and display element of the package of FIG. 1.
Figure 6:
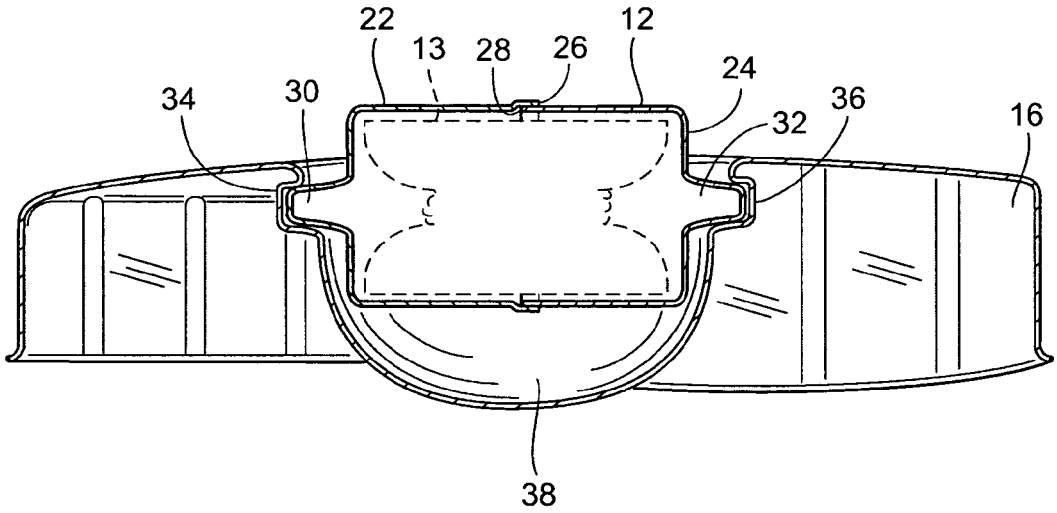
FIG. 6 is a cross-sectional view of the support element and display element of the package of FIG. 1 taken along line 6-6 of FIG. 5.

Referring to FIGS. 4 and 5, the center element 12 and support element 16 of the package 10 are illustrated independently of the outer package structure 14. In the illustrated embodiment, the support element 16 may be fabricated from PVC or any other polymer or appropriate material, and may be fully or partially transparent or translucent. Alternatively, the support element 16 may be fabricated from any material such that the support element 16 may be capable of supporting the center element 12 to display the product 13. As previously discussed, the surface of the support element 16 may define notches 34, 36 adapted to receive and retain the shafts 30, 32, respectively, of the center element 12. The surface of the support element 16 may further define a cavity 38 in which at least a portion of the center element 12 may be disposed when the shafts 30, 32 are disposed within the notches 34, 36. Referring to FIG. 6, the support element 16 may have a generally concave shape with a recessed portion of the support element 16 defining the notches 34, 36 and defining the cavity receiving at least a portion of the center element 12 when the shafts 30, 32 are disposed in the notches 34, 36. The cavity 38 may be configured such that the center element 12 may be free to rotate therewithin such that multiple sides of the product 13 may be viewable from the exterior of the package 10.

Figure 7:
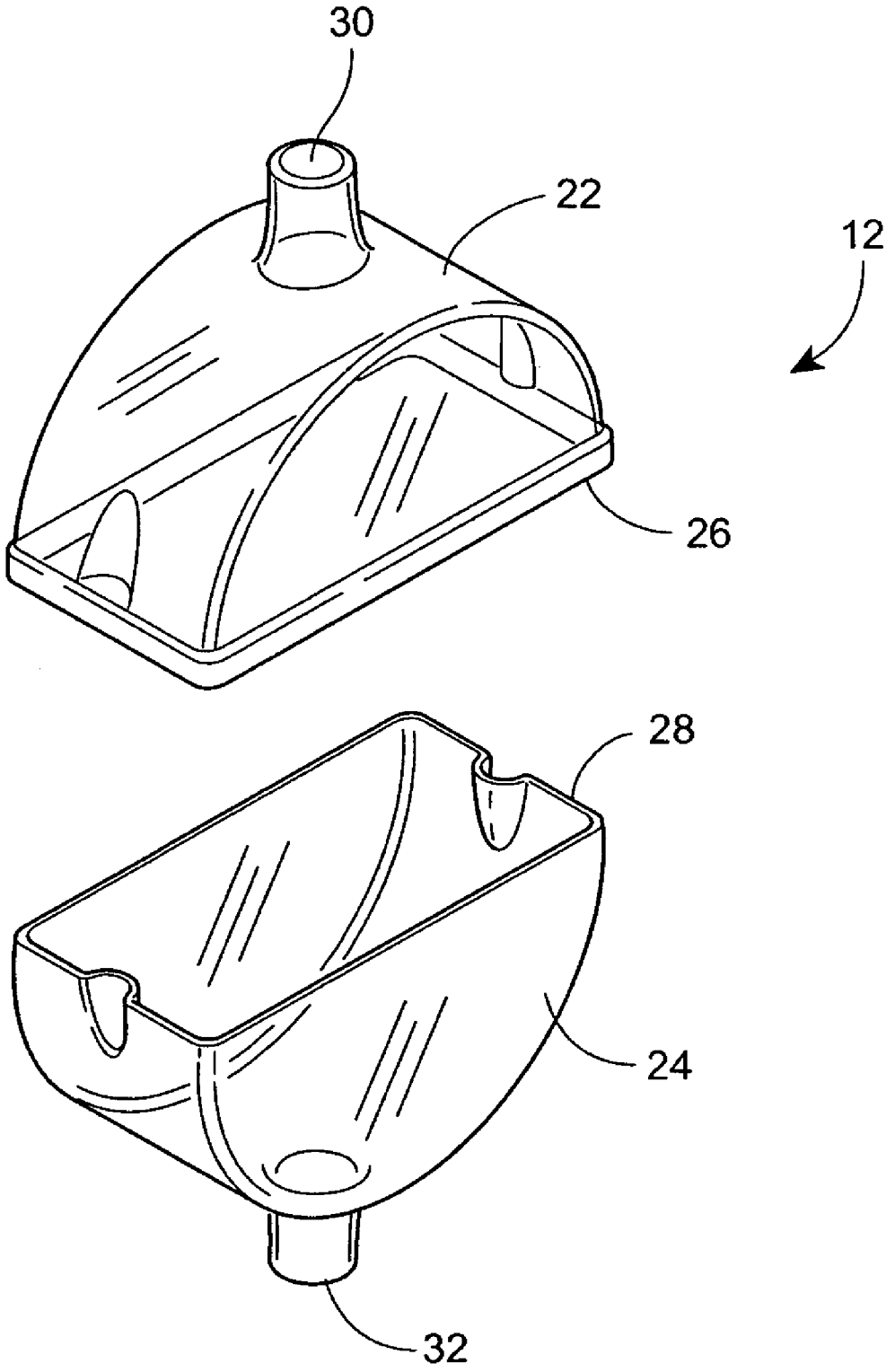
FIG. 7 is a perspective view of the display element of the package of FIG. 1 with the portions of the display element disengaged.

As previously, discussed, the center element 12 may include first and second portions 22, 24 defining the hollow compartment of the center element 12. Referring to FIG. 7, the center element 12 is illustrated with the first and second portions 22, 24 detached. During assembly, the product 13 to be displayed in the package 10 may be inserted into one of the portions 22, 24. The portions 22, 24 may then be demountably attached to each other to enclose the product within the hollow compartment of the center element 12 by inserting the edge 28 of the second portion 24 into the edge 26 of the first portion 22. The friction between the first and second portions 22, 24 may be sufficient to hold the first and second portions 22, 24 together or, alternatively, an additional fastening mechanism may be used to secure the portions 22, 24 and retain the product, such as an adhesive, adhesive tape, or any other appropriate fastening mechanism. Once the center element 12 is assembled, the center element 12 may be rotatably mounted within the cavity 38 of the support element 16 by inserting the shafts 30, 32 into the corresponding notches 34, 36 of the support element 16. If necessary, the support element 16 may be deformed sufficiently to allow insertion of both shafts 30, 32 into the notches 34, 36 before returning to the normal shape of the support element 16 to retentively engage and retain the center element 12. Once attached, the center element 12 and support element 16 may be inserted into the outer package structure 14 through, for example, the opening at the flap 17 with the center element 12 disposed proximate the opening 18, and with the package structure 14 engaging the center element 12 and/or the support element 16 to prevent the removal of the center element 12 from the support element 16 and the package structure 14 while the center element 12 and support element 16 are disposed therein.

In addition to the illustrated embodiment, alternative structures and embodiments for implementing a package having a removable center element for displaying multiple sides of a displayed product are contemplated by the inventor. As previously discussed, the outer package structure 14 may be fabricated from a fully or partially translucent material such that the center element 12 and support element 16 may be visible from multiple sides of the package structure 14. Moreover, the support element 16 may be configured to function as an outer package structure that may be retain the center element 12 and provide a surface for applying product identification, purchase and other information thereon. As a further alternative, the notches 34, 36 may be formed in the surface of the center element 12 and the shafts 30, 32 may be formed in the surface of the support element 16 and demountably engage the center element 12 to the support element 16 in a similar manner to allow rotation of the center element 12. Moreover, while the illustrated embodiment shows the center element 12 being capable of rotating through a complete 360° rotation about the axis of the shafts 30, 32, the center element 12, the cavity 38 of the support element 16 and/or the opening 18 of the package structure 14 may be configured to allow the center element 12 to rotate through an angle less than 360° but sufficient to display the desired portions of the product 13 enclosed within the center element 12. Still further, the package 10 may include alternative connection mechanisms to the shafts 30, 32 and notches 34, 36 that may allow the center element 12 to rotate within the package structure 14, or to move through paths other than pure rotational paths, such that the desired portions of the displayed product 13 may be visible to the potential purchasers. Additional embodiments will be apparent to those skilled in the art and are contemplated by the inventors as having use in a package in accordance to the present invention.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A package for displaying a product, comprising:

a center element defining a hollow compartment enclosing a product disposed therein, wherein multiple sides of the product are visible from the exterior of the center element;

a support element receiving the center element such that the center element is manually rotatable so that multiple sides of the product disposed within the center element are viewable by an individual; and two spaced pairs of aligned shafts and notches that cooperate to mount the center element in the support element, wherein the shafts are rotatable within the notches to allow rotation of the center element when engaged by the individual.

2. A package in accordance with claim 1, wherein each pair of aligned shafts and notches comprises a shaft extending from one of the center element and the support element; and a notch defined in the other of the support element and the center element and receiving the shaft therein.

3. A package in accordance with claim 2, wherein the compartment enclosing the product extends between the pairs of shafts and notches.

4. A package in accordance with claim 1, wherein the support element defines a cavity receiving at least a portion of the center element, and allowing rotation of the center element within the cavity and engagement of the center element by the individual.

5. A package in accordance with claim 1, wherein the center element is fabricated from a transparent material.

6. A package in accordance with claim 1, wherein the center element comprises first and second portions defining corresponding portions of the hollow compartment and engaging each other to define the hollow compartment and enclose the product stored therein.

7. A package in accordance with claim 6, wherein the first and second portions of the center element each include an edge defining an opening of the corresponding portion, and wherein the edge of the first portion receives the edge of the second portion to define the hollow compartment and enclose the product therein.

8. A package in accordance with claim 1, wherein the center element is rotatable through 360° of rotation by the individual when the center element is demountably engaged by the support element.

9. A package in accordance with claim 1, wherein the center element is manually engageable by an individual to rotate the center element.

10. A package for displaying a product, comprising:

a center element defining a hollow compartment enclosing a product disposed therein, wherein multiple sides of the product are visible from the exterior of the center element;

a support element for receiving at least a portion of the center element, such that the center element is manually rotatable so that multiple sides of the product disposed within the center element are viewable by an individual;

two spaced pairs of aligned shafts and notches that cooperate to rotatable mount the center element in the support element, wherein the shafts are rotatable within the notches to allow rotation of the center element when engaged by the individual; and a package structure receiving the center element and support element therein, and including an opening for viewing the product and manually rotating the center element.

11. A package in accordance with claim 10, wherein each pair of aligned shafts and notches comprises a shaft extending from of one of the center element and the support element; and a notch defined in the other of the support element and the center element and receiving the shaft therein.

12. A package in accordance with claim 11, wherein the compartment enclosing the product extends between the pairs of shafts and notches.

13. A package in accordance with claim 10, wherein the support element defines a cavity receiving at least a portion of the center element when the shafts are demountably received by the notches, and allowing rotation of the center element within the cavity and engagement of the center element by the individual.

14. A package in accordance with claim 10, wherein the center element is fabricated from a transparent material.

15. A package in accordance with claim 10, wherein the center element comprises first and second portions defining corresponding portions of the hollow compartment and engaging each other to define the hollow compartment and enclose the product stored therein.

16. A package in accordance with claim 15, wherein the first and second portions of the center element each include an edge defining an opening of the corresponding portion, and wherein the edge of the first portion receives the edge of the second portion to define the hollow compartment and enclose the product therein.

17. A package in accordance with claim 10, wherein the center element is rotatable through 360° of rotation by the individual when the shafts of the are received by the notches.

18. A package in accordance with claim 10, wherein the package structure engages at least one of the center element and the support element to prevent disengagement of the center element from the support element.

19. A package in accordance with claim 10, wherein the center element partially extends through the opening when the center element and support element are received by the package structure.

20. A package in accordance with claim 10, wherein the center element is manually engageable by an individual to rotate the center element.

21. A package in accordance with claim 10, wherein the notches receive the corresponding shafts to demountably engage the center element.

22. A package for displaying a product, comprising:

a center element comprising first and second portions engageable with one another to define a hollow compartment and to enclose a product to be displayed within the hollow compartment, wherein multiple sides of the product disposed within the hollow compartment are visible from an exterior of the center element;

a support element defining a cavity for receiving at least a portion of the center element therein, wherein the center element is rotatable within the cavity;

two spaced pairs of aligned shafts and notches that cooperate to rotatable mount the center element in the support element, wherein the shafts are rotatable within the notches to allow rotation of the center element when engaged by the individual; and a package structure receiving the center element and the support element therein, and including an opening for viewing the product and providing access to the center element from an exterior of the package structure, wherein the center element is rotatable about the shafts and engageable by an individual when the center element and the support structure are disposed within the package structure, and wherein the package structure engages at least one of the center element and the support element to retain the center element within the package structure when the center element and the support structure are disposed therein.

23. A package in accordance with claim 22, wherein each pair of aligned shafts and notches comprises a shaft extending from of one of the center element and the support element; and a notch defined in the other of the support element and the center element and receiving the shaft therein.

24. A package in accordance with claim 22, wherein the center element is fabricated from a transparent material.

25. A package in accordance with claim 22, wherein the package structure is fabricated from a transparent material.

26. A package in accordance with claim 22, wherein the first and second portions of the center element each include an edge defining an opening of the corresponding portion, and wherein the edge of the first portion receives the edge of the second portion to define the hollow compartment and enclose the product therein.

27. A package in accordance with claim 23, wherein the shafts outwardly extend from the center element and the package structure engages the shafts to retain the center element within the package structure when the center element and the support element are disposed therein.

28. A package in accordance with claim 22, wherein the package structure engages the support element to retain the center element within the package structure when the center element and the support element are disposed therein.

29. A package in accordance with claim 22, wherein the notches retentively engage the shafts when the shafts are rotatably disposed therein.

30. A package in accordance with claim 22, wherein the cavity of the support element has a generally concave shape.

31. A package in accordance with claim 23, wherein the notches are defined within a recessed portion of the support element.

32. A package in accordance with claim 22, wherein the product comprises a toy disposed within the hollow compartment defined by the first and second portions of the center element.

33. A package in accordance with claim 32, wherein the toy is a yo-yo.

* * * * *

UNITED STATES PATENT AND TRADEMARK OFFICE

CERTIFICATE OF CORRECTION

PATENT NO. : 7,513,369 B1
APPLICATION NO. : 11/075191
DATED : April 7, 2009
INVENTOR(S) : Choongseo Lee It is certified that error appears in the above-identified patent and that said Letters Patent is hereby corrected as shown below:

In the Claims:

At Column 7, line 19, "shafts of the are" should be -- shafts of the center element are --.

Signed and Sealed this

Thirtieth Day of March, 2010

David J. Kappos

David J. Kappos
*Director of the United States Patent and Trademark Office*